US011599044B2

(12) United States Patent
Suenami

(10) Patent No.: US 11,599,044 B2
(45) Date of Patent: Mar. 7, 2023

(54) IMAGE FORMING APPARATUS THAT CAN DECREASE VARIATIONS IN VOLUME AND WEIGHT OF DEVELOPER IN A DEVELOPMENT CASING

(71) Applicant: KYOCERA Document Solutions Inc., Osaka (JP)

(72) Inventor: Koji Suenami, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/687,475

(22) Filed: Mar. 4, 2022

(65) Prior Publication Data

US 2022/0308499 A1 Sep. 29, 2022

(30) Foreign Application Priority Data

Mar. 26, 2021 (JP) ..... JP2021-053195

(51) Int. Cl.
*G03G 15/08* (2006.01)

(52) U.S. Cl.
CPC ..... *G03G 15/0891* (2013.01); *G03G 15/0844* (2013.01); *G03G 15/0849* (2013.01); *G03G 15/0877* (2013.01); *G03G 15/0893* (2013.01); *G03G 2215/083* (2013.01); *G03G 2215/0833* (2013.01); *G03G 2215/0888* (2013.01)

(58) Field of Classification Search
CPC ..... G03G 15/0891; G03G 15/0849; G03G 15/0877; G03G 15/0893; G03G 2215/0888; G03G 2215/5008; G03G 15/0844; G03G 2215/083; G03G 2215/0833; G03G 2215/0838
See application file for complete search history.

(56) References Cited

U.S. PATENT DOCUMENTS

2015/0003876 A1 1/2015 Iida et al. ..... 399/254
2015/0153679 A1* 6/2015 Onuki ..... G03G 15/5008 399/53
2017/0248914 A1* 8/2017 Ge ..... G03G 15/5058

FOREIGN PATENT DOCUMENTS

JP 2009036786 A * 2/2009
JP 2012181477 A * 9/2012
(Continued)

*Primary Examiner* — Arlene Heredia
*Assistant Examiner* — Laura Roth
(74) *Attorney, Agent, or Firm* — Stein IP, LLC

(57) ABSTRACT

An image forming apparatus includes a development device, a toner storage part, a drive unit, a control unit, and an image carrying member. The development device includes a development casing, a developer carrying member, a first stirring transport member, a second stirring transport member, a discharge impeller, and a reverse transport impeller. The development casing includes a first partition wall, a communication part, a developer replenishment port, and a developer discharge part. The first stirring transport member includes a first rotation shaft and a first transport impeller. The second stirring transport member includes a second rotation shaft and a second transport impeller. The control unit can perform a developer discharge mode, in which the first rotation shaft and the second rotation shaft are rotated reversely during a non image formation period, so that the developer around the reverse transport impeller is discharged through the developer discharge part.

6 Claims, 6 Drawing Sheets

(56) References Cited

FOREIGN PATENT DOCUMENTS

| | | | | |
|---|---|---|---|---|
| JP | 2015-11158 | A | | 1/2015 |
| JP | 2015114506 | A | * | 6/2015 |

* cited by examiner

IMAGE FORMING APPARATUS THAT CAN DECREASE VARIATIONS IN VOLUME AND WEIGHT OF DEVELOPER IN A DEVELOPMENT CASING

INCORPORATION BY REFERENCE

This application is based upon and claims the benefit of priority from the corresponding Japanese Patent Application No. 2021-053195 filed Mar. 26, 2021, the entire contents of which are hereby incorporated by reference.

BACKGROUND

The present disclosure relates to an image forming apparatus.

The image forming apparatus using an electrophotographic method, such as a copier, a printer, a facsimile machine, or a multifunction peripheral thereof, includes a development device that develops a latent image formed on an image carrying member such as a photosensitive drum into a visualized toner image. As one of the development devices, there is one that adopts a two component development method using a two component developer containing carrier and toner. The development device of this method includes a development casing that stores the developer, a developing roller (developer carrying member) that supplies the developer to the image carrying member, and a stirring transport member that supplies the developer in the development casing to the developing roller while stirring and transporting the same.

In the development device of the two component development method described above, the toner is consumed by the development operation while the carrier is not consumed and remains in the development device. Then, the carrier in the development casing is stirred endlessly and is gradually deteriorated. As a result, carrier's charging performance to the toner is gradually deteriorated.

Therefore, there is proposed a development device equipped with a CASS (Carrier Auto Streaming System), which replenishes new developer containing carrier into the development casing while discharging excessive developer, so as to suppress deterioration in charging performance of the carrier due to its deterioration (Patent Document 1). The development device described in the Patent Document 1 is configured to replenish new two component developer and to discharge excessive developer containing carrier when volume of the developer in the development casing exceeds a predetermined volume, so that the carrier in the development casing is interchanged.

The development device described in the Patent Document 1 has a specific structure including a transport screw in the development casing and a return screw that has a reverse spiral to the transport screw and is disposed on a downstream side of the same in a discharging direction. The return screw is disposed in a developer discharge path. If volume of the developer is less than a predetermined volume, the developer is pushed back by the return screw and is prevented from being discharged outside the development casing. When new developer is replenished and volume of the developer increases to exceed a predetermined volume, excessive developer passes through a gap between an outermost part of the return screw and an inner wall surface of the development casing and is discharged from the development casing in such a manner as to go over the return screw.

In addition, the development device described in the Patent Document 1 includes a disk section disposed adjacent to the return screw in the developer discharge path (see FIG. 5 in the Patent Document 1). This disk section stabilizes developer discharge amount and suppresses splashing of the developer.

SUMMARY

An image forming apparatus according to one aspect of the present disclosure includes a development device, a toner storage part, a drive unit, a control unit, and an image carrying member. The development device includes a development casing, a developer carrying member, a first stirring transport member, a second stirring transport member, a discharge impeller, and a reverse transport impeller. The development casing includes a first transport chamber and a second transport chamber disposed in parallel to each other, a first partition wall for separating the first transport chamber and the second transport chamber along longitudinal direction thereof, a communication part for allowing the first transport chamber and the second transport chamber to communicate with each other at each end side of the first partition wall, a developer replenishment port for replenishing developer containing magnetic carrier and toner, and a developer discharge part disposed at a downstream side end of the second transport chamber so as to discharge excessive developer. The developer carrying member is supported by the development casing in a rotatable manner so as to carry the developer in the second transport chamber on surface thereof. The first stirring transport member includes a first rotation shaft disposed in the first transport chamber, and a first transport impeller formed on an outer circumferential surface of the first rotation shaft, so as to stir and transport the developer in the first transport chamber in a first direction, when the first rotation shaft rotates positively. The second stirring transport member includes a second rotation shaft disposed in the second transport chamber, and a second transport impeller formed on an outer circumferential surface of the second rotation shaft, so as to stir and transport the developer in the second transport chamber in a second direction opposite to the first direction, when the second rotation shall rotates positively. The discharge impeller is formed on a downstream side of the second transport impeller in the second direction, so as to transport the developer in the same direction as the second transport impeller, and to discharge the developer through the developer discharge part, when the second rotation shaft rotates positively. The reverse transport impeller is formed between the second transport impeller and the discharge impeller, so as to apply a transporting force to the developer in the second transport chamber in the opposite direction to the second transport impeller and the discharge impeller, when the second rotation shaft rotates positively. The toner storage part stores the developer to be replenished to the development device. The drive unit is connected to the second rotation shaft so as to rotate the second rotation shaft in positive and reverse directions. The control unit is connected to the drive unit and controls the second rotation shaft to rotate positively, while controlling the same to rotate reversely by a predetermined rotation amount at a predetermined time interval. The image carrying member forms an electrostatic latent image. When the second rotation shaft rotates positively or reversely, a developer transporting force of the reverse transport impeller is larger than that of the second transport impeller and the discharge impeller. The control unit is capable of performing a developer discharge mode, in which the first rotation shaft and the second rotation shaft are rotated reversely during a non image formation period, so that the developer around the reverse transport impeller is discharged through the developer discharge part.

DETAILED DESCRIPTION

Figure 1:
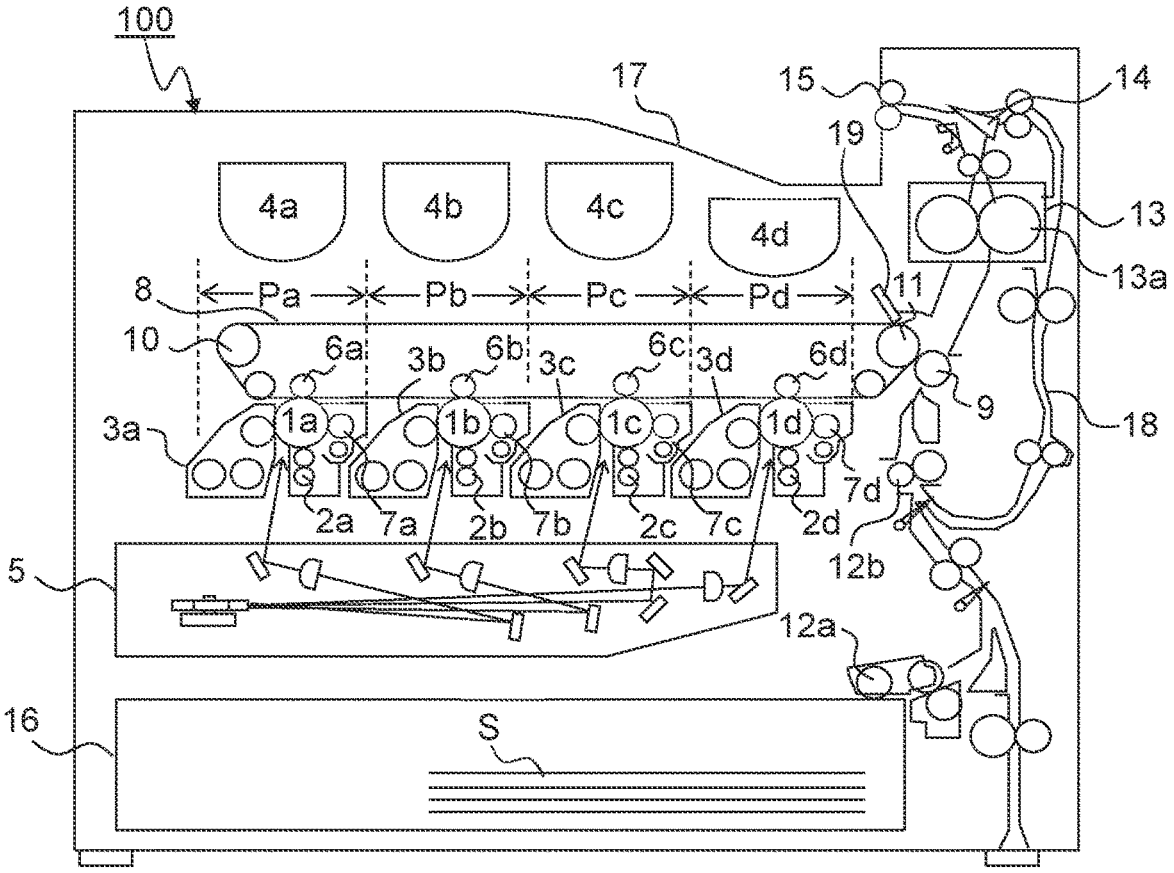
FIG. 1 is a cross-sectional view illustrating an internal structure of an image forming apparatus 100 equipped with development devices 3*a* to 3*d* according to the present disclosure.

Hereinafter, an embodiment of the present disclosure is described with reference to the drawings. FIG. 1 is a cross-sectional view illustrating an internal structure of an image forming apparatus 100 equipped with development devices 3*a* to 3*d* according to the present disclosure. In the image forming apparatus 100 (e.g. a color printer), four image forming units Pa, Pb, Pc, and Pd are disposed in order from an upstream side in a conveying direction (from the left side in FIG. 1). These image forming units Pa to Pd are disposed corresponding to four different color (cyan, magenta, yellow, and black) images, so as to form cyan, magenta, yellow, and black images in series by charging, exposing, developing, and transferring steps each.

These image forming units Pa to Pd are respectively equipped with photosensitive drums (image carrying members) 1*a*, 1*b*, 1*c*, and 1*d* for carrying visual images (toner images) of respective colors. Further, an intermediate transfer belt 8, which is driven by drive means (not shown) to turn in a counterclockwise direction in FIG. 1, is disposed adjacent to the image forming units Pa to Pd. The toner images formed on these photosensitive drums 1*a* to 1*d* are sequentially transferred and overlaid onto the intermediate transfer belt 8 that moves while contacting with the photosensitive drums 1*a* to 1*d*. After that, the toner image primarily transferred onto the intermediate transfer belt 8 is secondarily transferred by a secondary transfer roller 9 onto a paper sheet S as an example of a recording medium. Further, the paper sheet S with the secondarily transferred toner image is discharged to outside of the main body of the image forming apparatus 100 after the toner image is fixed in a fixing unit 13. In FIG. 1, the photosensitive drains 1*a* to 1*d* are rotated in a clockwise direction, and an image forming process is performed on each of the photosensitive drums 1*a* to 1*d*.

The paper sheet S on which the toner image is to be secondarily transferred is stored in a paper sheet cassette 16 disposed in a lower part of the main body of the image forming apparatus 100, and is conveyed by a sheet feed roller 12*a* and a registration roller pair 12*b* to a nip part between the secondary transfer roller 9 and a drive roller 11 of the intermediate transfer belt 8. The intermediate transfer belt 8 is made of a dielectric resin sheet, and is usually a seamless belt. In addition, on the downstream side of the secondary transfer roller 9, a blade-like belt cleaner 19 is disposed for removing toner and the like remaining on the surface of the intermediate transfer belt 8.

Next, the image forming units Pa to Pd are described. Around and below the photosensitive drums 1*a* to 1*d* disposed in a rotatable manner, there are disposed charging devices 2*a*, 2*b*, 2*c*, and 2*d* for charging the photosensitive drums 1*a* to 1*d*, respectively, an exposing device 5 for exposing the photosensitive drums 1*a* to 1*d* by image information, the development devices 3*a*, 3*b*, 3*c*, and 3*d* for forming toner images on the photosensitive drums 1*a* to 1*d*, respectively, and cleaning devices 7*a*, 7*b*, 7*c*, and 7*d* for removing developer (toner) and the like remaining on the photosensitive drums 1*a* to 1*d*, respectively.

When image data is input from a host device such as a personal computer, the charging devices 2*a* to 2*d* first uniformly charge the surfaces of the photosensitive drums 1*a* to 1*d*, respectively. Next, the exposing device 5 emits light in accordance with the image data, so as to form the electrostatic latent images on the photosensitive drums 1*a*. to 1*d* corresponding to the image data. The development devices 3*a* to 3*d* are filled with predetermined amounts of two component developers containing cyan, magenta, yellow, and black color toners, respectively. Note that, when the ratio of toner in the two component developer filled in the development device 3*a* to 3*d* becomes lower than a specified value due to toner image formation described later, a container 4*a* to 4*d* (toner storage part) replenishes developer containing toner and carrier to the development device 3*a* to 3*d*. The toner in the developer is supplied and adhered electrostatically to the photosensitive drum 1*a* to 1*d* by the development device 3*a* to 3*d*, and hence a toner image is formed corresponding to the electrostatic latent image formed by exposure from the exposing device 5.

Then, a primary transfer roller 6*a* to 6*d* applies an electric field of a predetermined transfer voltage between the primary transfer roller 6*a* to 6*d* and the photosensitive drum 1*a* to 1*d*, and hence the cyan, magenta, yellow; and black toner images on the photosensitive drums 1*a* to 1*d* are primarily transferred onto the intermediate transfer belt 8. These four color images are formed with a predetermined positional relationship that is determined in advance for forming a predetermined full color image. After that, as preparation for the next formation of a new electrostatic latent image, the cleaning devices 7*a* to 7*d* remove toner and the like remaining on the surfaces of the photosensitive drums 1*a* to 1*d*, respectively, after the primary transfer.

The intermediate transfer belt 8 is stretched around a driven roller 10 on the upstream side and the drive roller 11 on the downstream side. When the intermediate transfer belt 8 starts turning in the counterclockwise direction along with rotation of the drive roller 11 driven by a belt drive motor (not shown), the paper sheet S is conveyed from the registration roller pair 12*b* at a predetermined timing to a nip part (secondary transfer nip part) between the drive roller 11 and the secondary transfer roller 9 disposed adjacent thereto, and hence the full color image on the intermediate transfer belt 8 is secondarily transferred onto the paper sheet S. The paper sheet S with the secondarily transferred toner image is conveyed to the fixing unit 13.

The paper sheet S conveyed to the fixing unit 13 is heated and pressed by a fixing roller pair 13*a*, and the toner image is fixed to a surface of the paper sheet S, so that a predetermined full color image is formed. The paper sheet S with the full color image formed, whose convey direction is switched at a branch part 14 branching in a plurality of directions, is conveyed as it is (or after being sent to a both side conveying path 18 and after images are formed on both sides), and is discharged by a discharge roller pair 15 onto a discharge tray 17.

Figure 2:
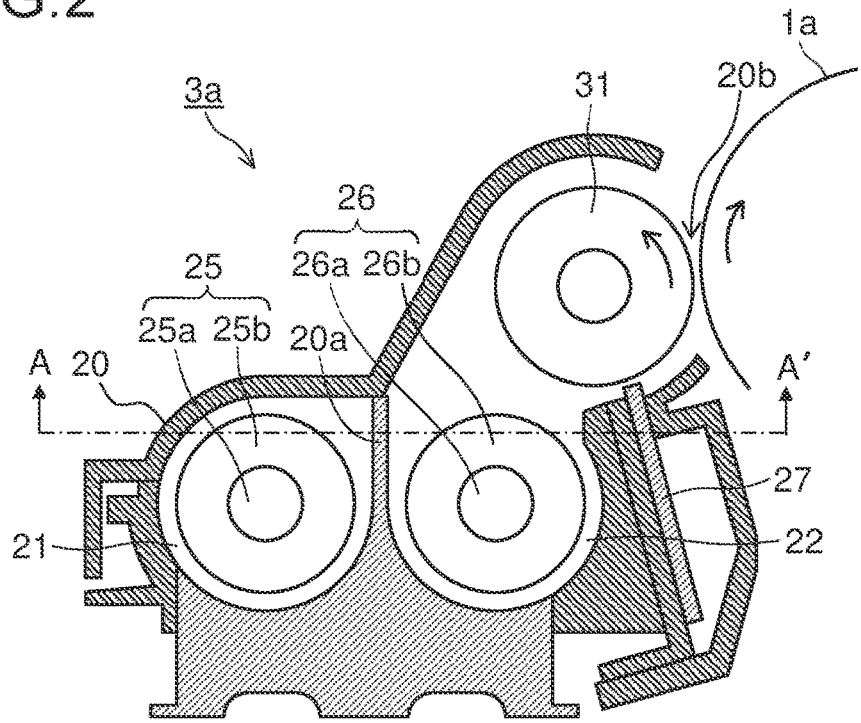
FIG. 2 is a cross-sectional side view of the development device 3*a* mounted in the image forming apparatus 100.

FIG. 2 is a cross-sectional side view of the development device 3*a* mounted in the image forming apparatus 100. Note that the development device 3*a* disposed in the image forming unit Pa illustrated in FIG. 1 is exemplified in the following description, and other development devices 3*b* to 3*d* disposed in the image forming units Pb to Pd, respectively, have the basically same structure, so descriptions thereof are omitted.

As illustrated in FIG. 2, the development device 3*a* includes a development casing 20 storing two component developer (hereinafter, also referred to simply as developer) containing magnetic carrier and toner. The development casing 20 is divided by a first partition wall 20*a* into a stirring transport chamber 21 and a feeding transport chamber 22. The stirring transport chamber 21 and the feeding transport chamber 22 are equipped with a stirring transport screw 25 and a feeding transport screw 26, respectively, which are disposed in a rotatable manner, for stirring and mixing the toner and carrier supplied from the container 4*a* (see FIG. 1) with the developer in the development casing 20, so as to charge the toner.

The stirring transport screw 25 disposed in the stirring transport chamber 21 includes a rotation shaft 25*a* (first rotation shaft) and a first transport impeller 25*b* formed integrally with the rotation shaft 25*a*, so as to have a spiral shape with a constant pitch in an axial direction of the rotation shaft 25*a*. The rotation shaft 25*a* is pivotally supported by the development casing 20 in a rotatable manner. When the stirring transport screw 25 rotates, it stirs and transports the developer in the stirring transport chamber 21 in a predetermined direction (to one side of the developing roller 31 in the axial direction).

The feeding transport screw 26 disposed in the feeding transport chamber 22 includes a rotation shaft 26*a* (second rotation shaft) and a second transport impeller 26*b* formed integrally with the rotation shaft 26*a*, so as to have a spiral shape in the same direction as the first transport impeller 25*b* (the same helical direction). The rotation shaft 26*a* is disposed in parallel to the rotation shaft 25*a* of the stiffing transport screw 25, and is pivotally supported by the development casing 20 in a rotatable manner. When the feeding transport screw 26 rotates, it stirs and transports the developer in the feeding transport chamber 22 in the opposite direction to the stirring transport screw 25, so as to feed the developer to the developing roller 31.

The stirring transport screw 25 and the feeding transport screw 26 stirs and transports the developer in the axial direction (in the direction perpendicular to paper of FIG. 2), and the developer circulates between the stirring transport chamber 21 and the feeding transport chamber 22 through an upstream side communication part 20*e* and a downstream side communication part 20*f* (see FIG. 3), which are formed at both end parts of the first partition wall 20*a*. In other words, the stirring transport chamber 21, the feeding transport chamber 22, the upstream side communication part 20*e*, and the downstream side communication part 20*f* constitute a circulation path for the developer in the development casing 20.

The development casing 20 extends to the upper right direction in FIG. 2 (in the direction approaching the photosensitive drum 1*a*), and the developing roller 31 is disposed in the development casing 20 on the upper right side of the feeding transport screw 26 (on the side closer to the photosensitive drum 1*a*). Further, a part of the outer circumferential surface of the developing roller 31 is exposed from an opening 20*b* of the development casing 20, so as to face the photosensitive drum 1*a*. The developing roller 31 rotates in the counterclockwise direction in FIG. 2. The developing roller 31 is applied with a development voltage including an AC voltage superimposed on a DC voltage.

In FIG. 2, the developing roller 31 is constituted of a cylindrical developing sleeve that rotates in the counterclockwise direction, and a magnet fixed in the developing sleeve to have a plurality of magnetic poles (not shown). Note that the developing sleeve having a knurled surface is used for example, but it may be possible to use the developing sleeve having a dimpled surface or a blasted surface.

In addition, a regulating blade 27 is attached to the development casing 20 along the longitudinal direction of the developing roller 31 (the direction perpendicular to paper of FIG. 2). A small gap is formed between the distal end of the regulating blade 27 and the surface of the developing roller 31.

Figure 3:
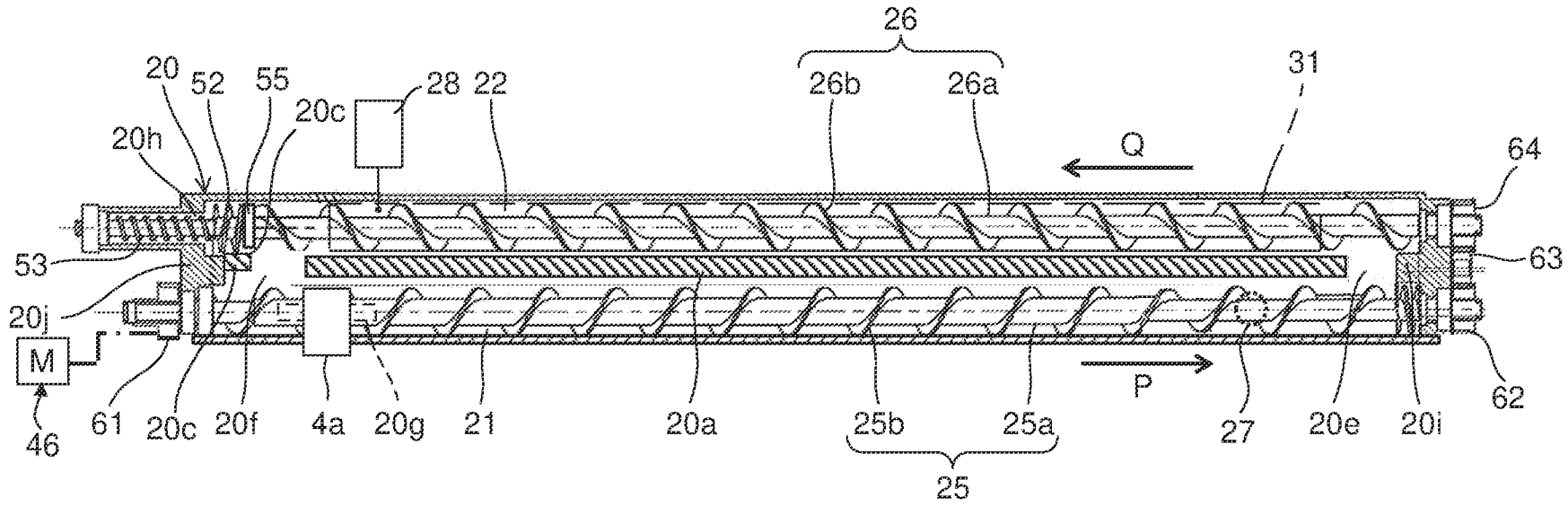
FIG. 3 is a cross-sectional plan view illustrating a stirring part of the development device 3*a*.

In addition, the development casing 20 is equipped with a toner concentration detection sensor 28 that can detect toner concentration in the developer inside thereof (see FIG. 3). The toner concentration detection sensor 28 is connected to a control unit 90 described later and sends the detection result to the control unit 90 (see FIG. 5).

Next, a structure of a stiffing part of the development device 3*a* is described in detail. FIG. 3 is a cross-sectional plan view of the stirring part of the development device 3*a* (a cross-sectional view taken along the AA' line in FIG. 2), and FIG. 4 is an enlarged partial view of a developer discharge part 20*h* and its vicinity illustrated in FIG. 3.

Figure 4:
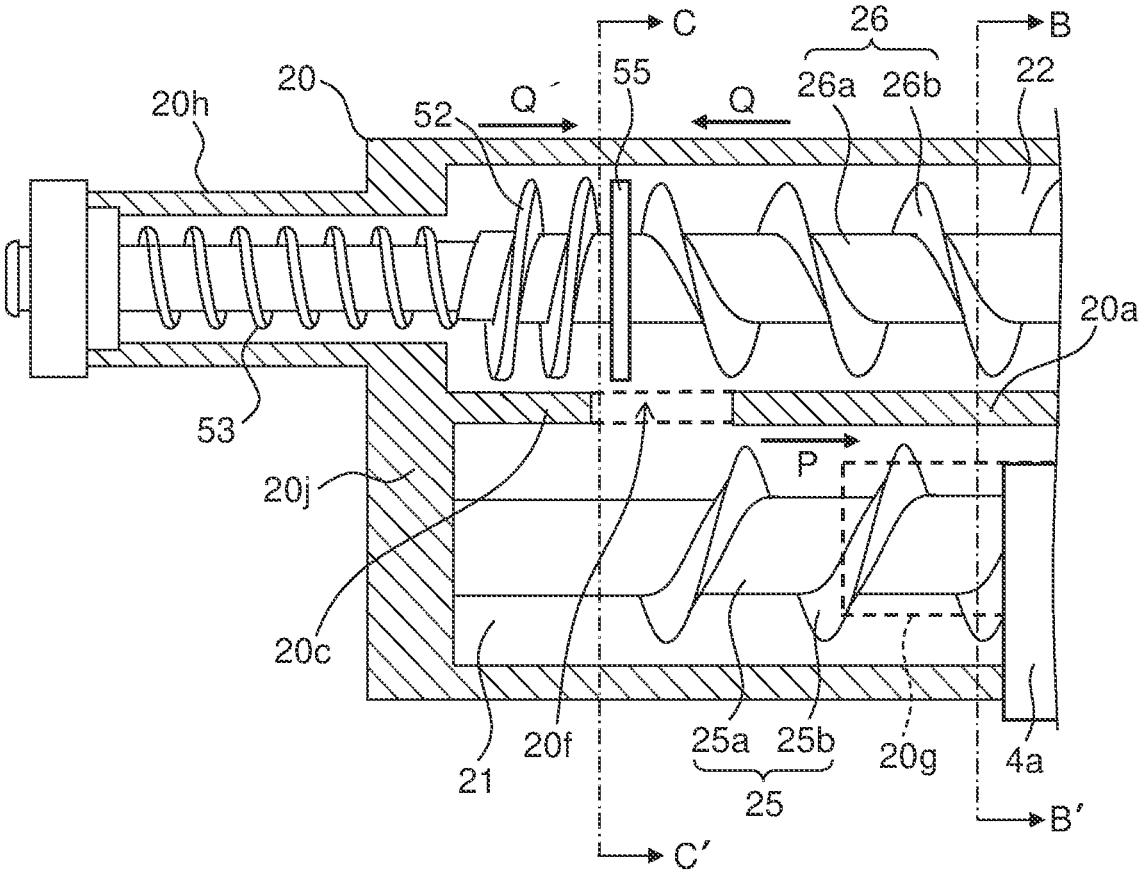
FIG. 4 is an enlarged partial view of a developer discharge part 20*h* and its vicinity illustrated in FIG. 3.

As illustrated in FIGS. 3 and 4, the development casing 20 has the stirring transport chamber 21, the feeding transport chamber 22. the first partition wall 20*a*, a second partition wall 20*c*, the upstream side communication part 20*e*, and the downstream side communication part 20*f*. In addition, a developer replenishment port 20*g*, the developer discharge part 20*h*, an upstream side wall part 20*i*, and a downstream side wall part 20*j* are provided to the development casing 20. Note that, in the stirring transport chamber 21, the left side in FIG. 3 is the upstream side, and the right side in FIG. 3 is the downstream side. In addition, in the feeding transport chamber 22, the right side in FIG. 3 is the upstream side, and the left side in FIG. 3 is the downstream side. Therefore, as for the communication part and the wall part, the upstream side and the downstream side are referred to with respect to the feeding transport chamber 22.

The first partition wall 20*a* extends in the longitudinal direction of the development casing 20 so as to divide the same into the stirring transport chamber 21 and the feeding transport chamber 22 in parallel. The second partition wall 20*c* protrudes from the inner wall surface of the downstream side wall part 20*j* and is formed on an extension line of the first partition wall 20*a*, so as to face an outer circumferential surface of a spiral impeller constituting a reverse transport impeller 52.

The right side end part of the first partition wall 20*a* in the longitudinal direction constitutes the upstream side communication part 20*e* together with an inner wall part of the upstream side wall part 20*i*. On the other hand, the left side end part of the first partition wall 20*a* in the longitudinal direction constitutes the downstream side communication part 20*f* together with the second partition wall 20*c*.

The developer replenishment port 20*g* is an opening for replenishing new toner and carrier from the container 4*a* disposed above the development casing 20 to inside of the development casing 20, and is formed on the upstream side (the left side in FIG. 3) of the stirring transport chamber 21.

The developer discharge part 20*h* discharges excessive developer in the stirring transport chamber 21 and the feeding transport chamber 22 when the developer is replenished. The developer discharge part 20*h* is formed continuously to the downstream side end of the feeding transport chamber 22 in the longitudinal direction of the feeding transport chamber 22.

The stirring transport screw 25 extends to both end sides of the stirring transport chamber 21 in the longitudinal direction, and the first transport impeller 25*b* is formed to face also the upstream side communication part 20*e* and the downstream side communication part 20*f*. The rotation shaft 25*a* is pivotally supported in a rotatable manner by the upstream side wall part 20*i* and the downstream side wall part 20*j* of the development casing 20.

The feeding transport screw 26 has an axial direction length more than or equal to that of the developing roller 31, and further extends to a position facing the upstream side communication part 20*e*. The rotation shaft 26*a* is disposed in parallel to the rotation shaft 25*a* of the stirring transport screw 25, and is pivotally supported in a rotatable manner by the upstream side wall part 20*i* and the developer discharge part 20*h* of the development casing 20. The reverse transport impeller 52 and a discharge impeller 53 are formed integrally with the rotation shaft 26*a* of the feeding transport screw 26, together with the second transport impeller 26*b*.

The reverse transport impeller 52 blocks the developer transported to the downstream side in the feeding transport chamber 22, and conveys the developer that has become a predetermined volume or more to the developer discharge part 20*h*. The reverse transport impeller 52 is a spiral impeller provided to the rotation shaft 26*a* and is a spiral impeller having the opposite direction (opposite helical direction) to the second transport impeller 26*b*. The outside diameter of the reverse transport impeller 52 is larger than or equal to that of the second transport impeller 26*b*, and the pitch of the reverse transport impeller 52 is smaller than that of the second transport impeller 26*b*. The reverse transport impeller 52 transfers the developer in the periphery thereof in the opposite direction to the second transport impeller 26*b*.

The rotation shaft 26*a* in the developer discharge part 20*h* is provided with the discharge impeller 53. The discharge impeller 53 is a spiral impeller having the same direction as the second transport impeller 26*b*, and it has a smaller pitch and a smaller outside diameter than the second transport impeller 26*b*.

The transporting force of the reverse transport impeller 52 to transport the developer is larger than the transporting force of the second transport impeller 26*b* and the discharge impeller 53 to transport the developer.

As illustrated in FIG. 3, outside the development casing 20, there is disposed a drive unit 46 capable of rotating the rotation shafts 25*a* and 26*a* and the developing roller 31 in positive and reverse directions. The drive unit 46 includes a development drive motor M disposed at an arbitrary position in the image forming apparatus 100, and gears 61 to 64 for transmitting a rotation drive force of the development drive motor M to the rotation shafts 25*a* and 26*a*. The gear 61 is fixed to one end of the rotation shaft 25*a* and is connected to the development drive motor M. The gear 62 is fixed to the other end of the rotation shaft 25*a* (end part opposite to the end part to which the gear 61 is fixed). The gear 64 is fixed to the rotation shaft 26*a*, and the gear 63 is supported by the development casing 20 in a rotatable manner and engages with the gears 62 and 64. The development drive motor M is connected to the control unit 90 that will be described later (see FIG. 5).

When the development drive motor M drives the gear 61 to rotate, the stirring transport screw 25 rotates. The developer in the stirring transport chamber 21 is transported by the first transport impeller 25*b* in a main transport direction (a first direction or an arrow P direction). After that, the developer passes through the upstream side communication part 20*e* and is transported into the feeding transport chamber 22. Further, as the feeding transport screw 26 rotates positively via the gears 62 to 64. the developer in the feeding transport chamber 22 is transported by the second transport impeller 26*b* in the main transport direction (a second direction or an arrow Q direction).

As the toner is consumed by the development process, a developer replenishment motor 41 (see FIG. 5) is driven so that the developer containing toner and magnetic carrier is replenished from the container 4*a* into the development casing 20 via a developer replenishment port 22*g*. The developer is replenished in accordance with a toner consumption amount in the development casing 20, but the toner consumption amount varies depending on a print coverage rate of the image to be printed or a paper sheet size. Therefore, the amount of developer replenishment or replenishment timing also varies depending on the print coverage rate or the paper sheet size. Note that the developer in the development device 3*a* contains approximately 10 weight percent of toner with respect to the carrier, in a state where the toner adheres around the carrier. On the other hand, the replenishment developer (developer replenished through the developer replenishment port 22*g*) contains approximately 3 weight percent of carrier, in a state where the carrier is dotted in the toner.

After the developer is replenished, in the same manner as the development process, the stirring transport screw 25 transports the developer in the stirring transport chamber 21 in the main transport direction (arrow P direction), and then the developer passes through the upstream side communication part 20*e* and is transported into the feeding transport chamber 22. Further, the feeding transport screw 26 transports the developer in the feeding transport chamber 22 in the main transport direction (arrow Q direction). As described above, the reverse transport impeller 52 is a spiral impeller having the helical direction opposite to the second transport impeller 26*b*. Therefore, when the reverse transport impeller 52 rotates along with the rotation of the rotation shaft 26*a*, the reverse transport impeller 52 applies the developer with a transporting force in the opposite direction to the main transport direction (in an opposite transport direction or an arrow Q' direction). Then, the developer around the reverse transport impeller 52 is transported in the opposite direction to the main transport direction. In other words, when the feeding transport screw 26 rotates positively, the developer is transported from the stirring transport chamber 21 into the feeding transport chamber 22 through the upstream side communication part 20*e* while fluctuating its volume largely, is pushed back by the reverse transport impeller 52, and is transported to the stirring transport chamber 21 through the downstream side communication part 20*f*.

In this way, the developer is stirred and circulated from the stirring transport chamber 21 to the upstream side communication part 20*e*, and to the feeding transport chamber 22, and to the downstream side communication part 20*f*, so that the stirred developer is supplied to the developing roller 31.

As illustrated in FIG. 4, the feeding transport screw 26 has a disk 55 disposed between the second transport impeller 26*b* and the reverse transport impeller 52. The disk 55 is made of synthetic resin together with the second transport impeller 26*b*, the reverse transport impeller 52, and the discharge impeller 53, so as to be integral with the rotation shaft 26*a*.

The disk 55 blocks and weakens temporarily the transporting force applied to the developer transported by the second transport impeller 26*b* in the main transport direction (arrow Q direction). Then, the reverse transport impeller 52 applies the developer with a transporting force in the opposite direction, so as to push back the developer in the opposite direction to the main transport direction. In other words, the disk 55 play a role to decrease the developer transporting force (pressure) in the direction from the feeding transport chamber 22 to the reverse transport impeller 52. As a result, a ripple (fluctuation) of a developer surface moving to the reverse transport impeller 52 and the downstream side communication part 20*f* is suppressed, and hence a substantially constant amount of developer can stay around the reverse transport impeller 52 regardless of transport speed of the developer.

The image forming apparatus 100 of the present disclosure can switch between two process speeds in accordance with thickness or type of the paper sheet S to be conveyed, or type of output image. In other words, when the paper sheet S is a plain paper sheet or when printing text, the image forming process is performed at normal drive speed (hereinafter, referred to as a full speed mode). When the paper sheet S is a thick paper sheet or when printing photograph, the image forming process is performed at a speed lower than the normal speed (hereinafter, referred to as a deceleration mode). In this way, when using a thick paper sheet as the paper sheet S or when printing photograph, a sufficient fixing time is ensured so that image quality can be improved.

Next, the case where the feeding transport screw 26 rotates reversely (a developer discharge mode) is described. When the drive unit 46 drives the feeding transport screw 26 to rotate reversely, the second transport impeller 26*b* and the discharge impeller 53 transports the developer around them in the opposite transport direction (arrow Q' direction). As described above, the transporting force of the reverse transport impeller 52 to transport the developer is larger than that of the second transport impeller 26*b* and the discharge impeller 53 to transport the developer. Therefore, the reverse transport impeller 52 transports the developer around the downstream side communication part 20*f* and the reverse transport impeller 52, in the main transport direction (arrow Q direction) against the transporting force of the second transport impeller 26*b* and the discharge impeller 53 in the opposite transport direction, and hence the developer is sent to the left side in FIG. 4 and is discharged outside of the development casing 20 through a developer outlet (not shown).

Figure 5:
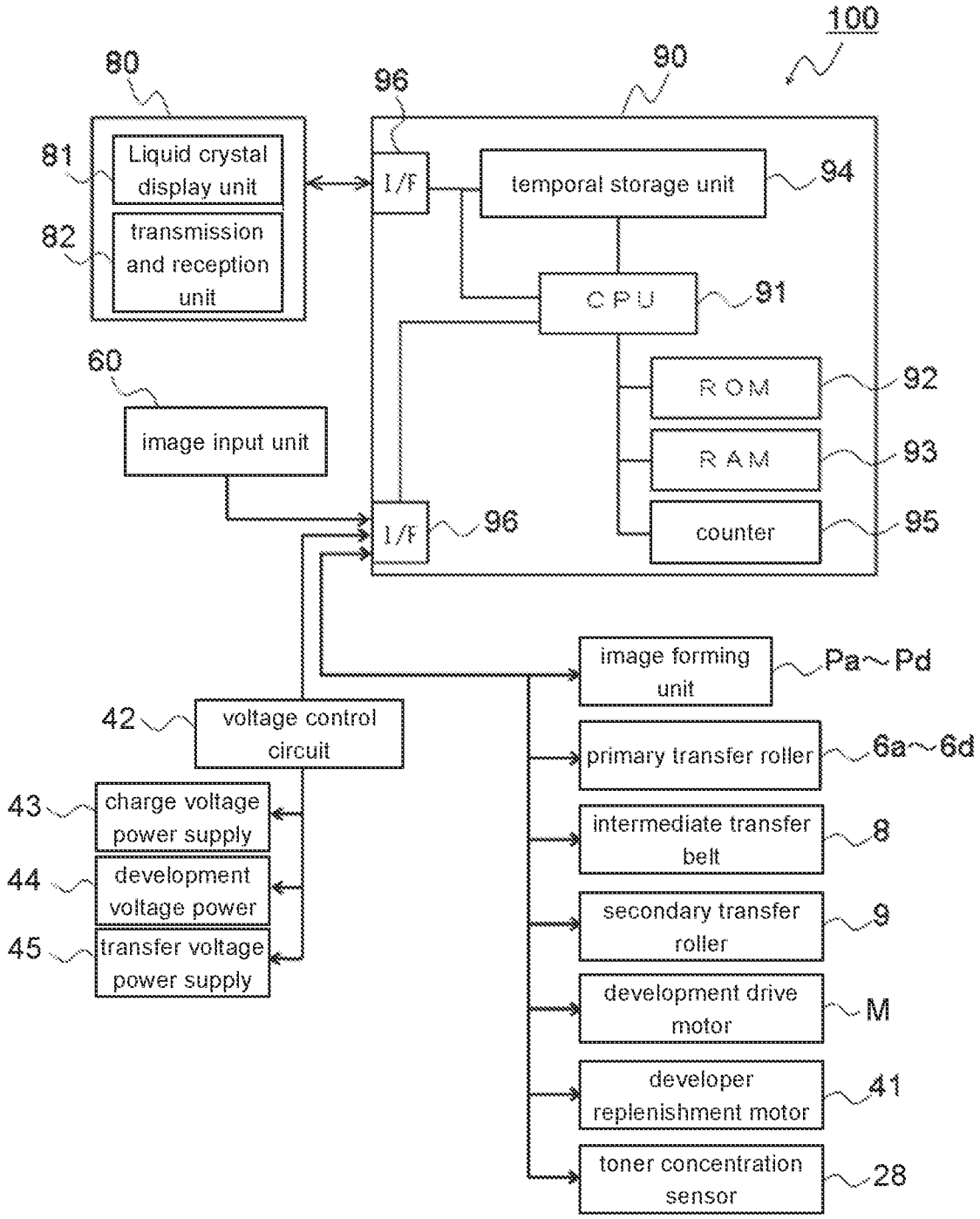
FIG. 5 is a block diagram illustrating an example of a control path used in the image forming apparatus 100.

Next, a control path of the image forming apparatus 100 is described. FIG. 5 is a block diagram illustrating an example of the control path used in the image forming apparatus 100. Note that various controls of individual portions of the image forming apparatus 100 are performed when it is used, and hence the entire control path of the image forming apparatus 100 is complicated. Therefore, a part of the control path necessary for implementing the present disclosure is mainly described below.

The control unit 90 includes at least a central processing unit (CPU) 91, a read only memory (ROM) 92 as a storage unit dedicated to reading, a random access memory (RAM) 93 as a storage unit that can read and write, a temporal storage unit 94 that temporarily stores image data or the like, a counter 95, and a plurality of (e.g. two) interfaces (I/F) 96 for sending control signals to individual devices in the image forming apparatus 100 and receiving input signals from an operation unit 80. In addition, the control unit 90 can be disposed at any position inside the main body of the image forming apparatus 100.

The ROM 92 stores a program for controlling the image forming apparatus 100, data such as numeric values necessary for control, and the like, which are not changed during use of the image forming apparatus 100. The RAM 93 stores necessary data generated during control of the image forming apparatus 100, data necessary temporarily for control of the image forming apparatus 100, and the like. The counter 95 accumulates and counts the number of printed sheets.

In addition, the control unit 90 sends control signals from the CPU 91 to the individual portions and devices of the image forming apparatus 100 via the I/F 96. In addition, the individual portions and devices send signals indicating the states thereof and input signals to the CPU 91 via the I/F 96. The individual portions and devices to be controlled by the control unit 90 include, for example, the image forming units Pa to Pd, the exposing device 5, the primary transfer rollers 6*a* to 6*d*, the intermediate transfer belt 8, the secondary transfer roller 9. the development drive motor M, the developer replenishment motor 41, the toner concentration detection sensor 28, a voltage control circuit 42, the operation unit 80, and the like.

An image input unit 60 is a receiving unit that receives image data sent from a. personal computer or the like to the image forming apparatus 100. The image signal input from the image input unit 60 is converted into a digital signal, which is sent to the temporal storage unit 94.

The voltage control circuit 42 is connected to a charge voltage power supply 43, a development voltage power supply 44, and a transfer voltage power supply 45, so as to operate these power supplies in accordance with output signals from the control unit 90. In accordance with control signals from the voltage control circuit 42, the charge voltage power supply 43 applies predetermined voltages to the charging devices 2*a* to 2*d*, the development voltage power supply 44 applies predetermined voltages to the developing rollers 31 in the development devices 3*a* to 3*d*, and the transfer voltage power supply 45 applies predetermined voltages to the primary transfer rollers 6*a* to 6*d* and the secondary transfer roller 9.

The operation unit 80 is equipped with a liquid crystal display unit 81 and a transmission and reception unit 82. The liquid crystal display unit 81 displays a status of the image forming apparatus 100, and displays an image forming status or the number of printed sheets. Various settings for the image forming apparatus 100 are performed using a printer driver of the personal computer. The transmission and reception unit 82 performs communication with outside using a telephone line or the Internet.

The development drive motor M is connected to the control unit 90 as described above, and is controlled by the control unit 90 so that rotational frequency, rotational speed, rotational direction, and the like thereof can be adjusted. The ROM 92 stores rotational frequencies and the like of the development drive motor M in various operation modes (the developer discharge mode, the full speed mode, the deceleration mode, and the like) described above, and the control unit 90 switches the operation modes.

Figure 6:
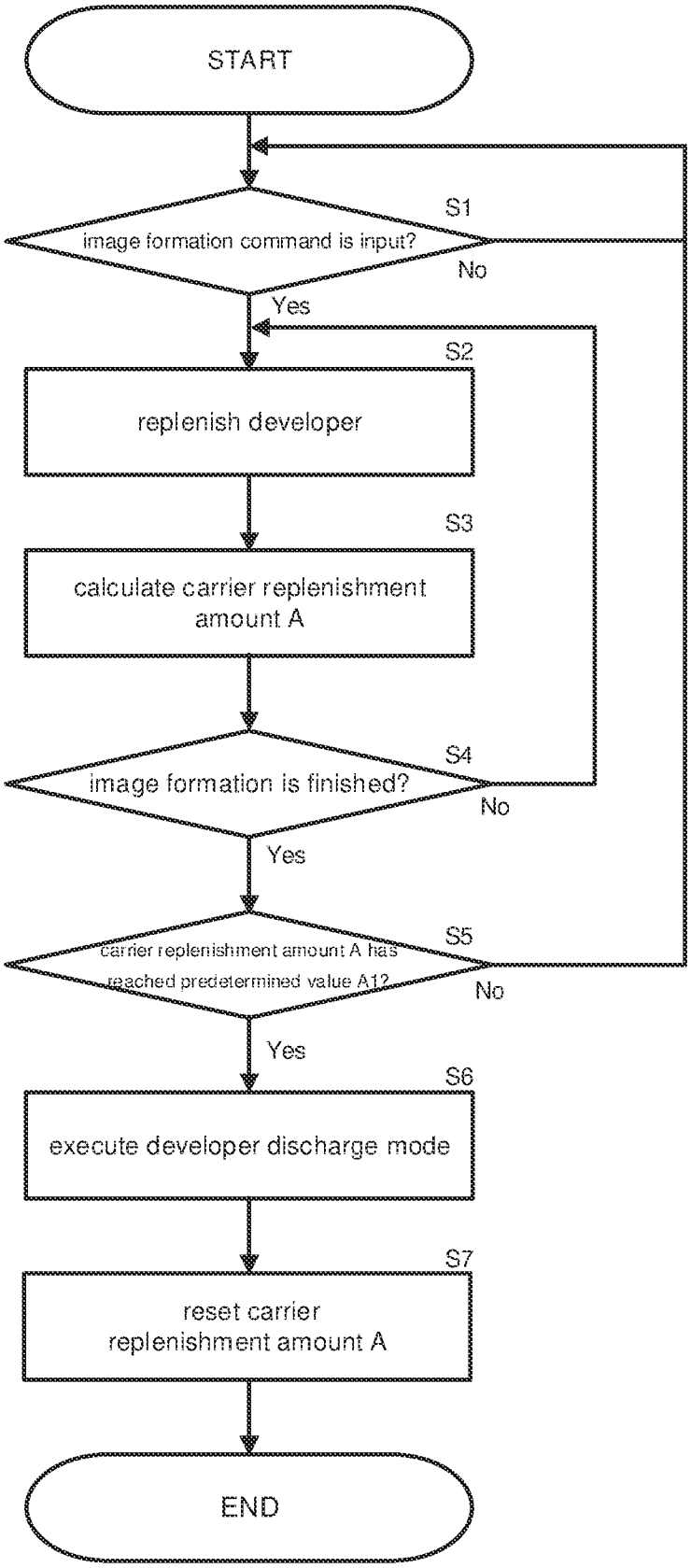
FIG. 6 is a flowchart illustrating a drive control example of the development devices 3*a* to 3*d* in the image forming apparatus 100 of this embodiment.

Next, a drive control example of the development devices 3*a* to 3*d* in the image forming apparatus 100 of this embodiment is described with reference to the flowchart illustrated in FIG. 6.

The control unit 90 determines whether or not an image formation command is input from a host device such as a personal computer (Step S1). If the image formation command is not input (No in Step S1), a waiting state for the image formation command is continued. When the image formation command is input (Yes in Step S1), developer is replenished into the development casing 20 in accordance with the current toner consumption amount (Step S2). In this case, the control unit 90 calculates an amount of carrier replenished into the development casing 20 (hereinafter, referred to as a carrier replenishment amount A) (Step S3). Specifically, the carrier replenishment amount A is calculated by multiplying the replenished developer amount by carrier concentration ratio. The calculated carrier replenishment amount A is recorded in the temporal storage unit 94.

Next, the control unit 90 determines whether image formation is finished or not (Step S4). If the image formation is still being performed (No in Step S4), the process flow returns to Step S1, so as to continue the image formation and to continue replenishment of developer and calculation of the carrier replenishment amount. In Step S4, if the image formation is finished (Yes in Step S4), it is determined whether or not the carrier replenishment amount A calculated in Step S3 has reached a predetermined value A1 (Step S5). The predetermined value A1 is an amount of developer around the reverse transport impeller 52 in a standard state and is a value recorded in the ROM 92 in advance.

In Step S5, if the carrier replenishment amount A has exceeded the predetermined value A1 (Yes in Step S5), the developer discharge mode is executed (Step S6). Specifically, the feeding transport screw 26 is rotated reversely by a predetermined rotation amount. Developer discharge amounts at individual rotational frequencies when the feeding transport screw 26 rotates reversely are recorded in the ROM 92. On the basis of this record, the control unit 90 determines the rotational frequency of the feeding transport screw 26 when it rotates reversely, so that the developer discharge amount is equal to the carrier replenishment amount A described above. Next, the value of the carrier replenishment amount A recorded in Step S3 is reset (Step S7).

In Step S5, if the carrier replenishment amount A has not exceeded the predetermined value A1 (No in Step S5), the process flow returns to Step S1, and the waiting state for the image formation command is continued.

As described above, when the rotation shaft 26*a* rotates positively or reversely, the transporting force of the reverse transport impeller 52 to transport the developer is larger than that of the second transport impeller 26*b* and the discharge impeller. Further, the control unit 90 can perform the developer discharge mode by controlling the rotation shaft 25*a* and the rotation shaft 26*a* to rotate reversely during a non image formation period. Therefore, as the control unit 90 performs the developer discharge mode regularly at a predetermined time interval, a constant amount of developer can be discharged regardless of humidity in the use environment, and hence a volume variation of the developer in the development casing 20 and a weight variation of the same can be reduced.

Therefore, it is possible to provide the image forming apparatus 100 that can reduce the volume variation of the developer in the development casing 20 and can also reduce the weight variation in the development casing 20, even if flowability of the developer has changed.

Other than that, the present disclosure is not limited to the embodiment described above, but can be variously modified within the scope of the present disclosure without deviating from the spirit thereof. For instance, the development devices 3*a* to 3*d* including the developing roller 31 as illustrated in FIG. 2 are exemplified and described in the embodiment described above, but this is not a limitation. For instance, the present disclosure can be applied to various development devices using two component developer containing toner and carrier, such as a development device including a magnetic roller for carrying developer, in which only toner is moved from the magnetic roller to the developing roller 31 so as to form a toner layer, and the toner layer on the developing roller 31 is used for developing the electrostatic latent image.

In addition, it may be possible that the control unit 90 changes the predetermined value A1 of the carrier replenishment amount described above (a threshold value of the carrier replenishment amount when performing the developer discharge mode), in accordance with the detection result of the toner concentration detection sensor 28. In this case, if the toner concentration in the development casing 20 is larger than a predetermined value, the predetermined value A1 is decreased. Then, when the toner concentration in the development casing 20 is increased so that flowability of the developer is changed, the execution interval of the developer discharge mode is shortened. In this way, even if the flowability of the developer is changed, the volume and weight of the developer are hardly changed and become stable.

In addition, when image formation is performed in a low speed mode in which the rotational speed of the feeding transport screw 26 is less than a predetermined value, the control unit 90 can set the predetermined value A1 of the carrier replenishment amount described above to be small.

In addition, the present disclosure can be applied to not only the tandem type color printer illustrated in FIG. 1 but also various image forming apparatuses using the two component development method, such as a digital or analog type monochrome copier, monochrome printer, color copier, or facsimile machine. Hereinafter, effects of the present disclosure are further described in detail with Example.

EXAMPLE

In the image forming apparatus 100 as illustrated in FIG. 1, change in the developer in the development devices 3*a* to 3*d*, when humidity in the use environment changes, was studied. Note that the test was performed in the cyan image forming unit Pa including the photosensitive drum 1*a* and the development device 3*a*.

As the test method, the image forming apparatus 100 as illustrated in FIG 1 was used, a predetermined image was printed on 20,000 paper sheets S, the weight of developer in the development casing 20 was measured every time when the number of printed sheets reached 1,000. The developer discharge mode described above was executed as the present disclosure, while the developer discharge mode was not executed in a comparative example (specific structures of the development devices of the present disclosure and the comparative example are described later).

The first transport impeller 25*b* and the second transport impeller 26*b* of the stirring transport screw 25 and the feeding transport screw 26 of the development device 3*a* used in the image forming apparatuses 100 of the present disclosure and the comparative example are spiral impellers having an outside diameter of 18 mm, and the first partition wall 20*a* has a height of 15 mm. In addition, the second partition wall 20*c* of the present disclosure and the comparative example has a height of 8 mm, and the discharge impeller 53 is a spiral impeller having an outside diameter of 8 mm. In addition, in the present disclosure and the comparative example, there is a space of 1.5 mm between the discharge impeller 53 and an upper surface of the developer discharge part 22*h*.

The transporting force of the reverse transport impeller 52 of the development device 3*a* used in the image forming apparatus 100 of the present disclosure is set larger than the transporting force of a restricting part of the comparative example. Specifically, the reverse transport impeller 52 is constituted of three spiral impellers having the opposite helical direction and an outside diameter of 18 mm. In contrast, the reverse transport impeller 52 of the development device 3*a* used in the image forming apparatus 100 of the comparative example is constituted of three spiral impellers having the opposite helical direction and an outside diameter of 16 mm. In addition, there was a space (clearance) of 1.5 mm between an upper surface of the feeding transport chamber 22 and the second transport impeller 26*b* or the reverse transport impeller 52 in the present disclosure. In contrast, there is a space (clearance) of 2.5 mm between the upper surface of the feeding transport chamber 22 and the restricting part in the comparative example.

In addition, the disk 55 having a diameter of 18 mm was formed between the second transport impeller 26*b* of the feeding transport screw 26 and the reverse transport impeller 52 in the development device 3*a* used in the image forming apparatuses 100 of the present disclosure and the comparative example. The disk 55 was disposed at a position of 2 mm from the downstream side end of the downstream side communication part 20*f* toward the upstream side (the right side in FIG. 4) in the developer transport direction in the feeding transport chamber 22.

The image forming apparatuses 100 of the present disclosure and the comparative example replenish the developer from the container 4*a* so that 3 g of the carrier is supplied every time when the number of printed sheets reaches 1,000. The image forming apparatus 100 of the comparative example has a structure in which when the developer volume has exceeded a predetermined volume, the developer that has got over the reverse transport impeller 52 is discharged as the excessive developer from the development casing 20. In contrast, the development devices 3*a* to 3*d* of the image forming apparatus 100 of the present disclosure have the structure described above, in which when the carrier supply amount becomes substantially the same as the developer amount around the reverse transport impeller 52, the developer discharge mode is executed so as to discharge the developer of approximately the same amount as the carrier supply amount.

The test was performed by using the developer having a toner concentration of 8% and a carrier ratio of 10%, and by setting an initial value of the developer amount at 300 g. In addition, an initial value of absolute humidity is set to 5 g/m$^3$, and it is changed sequentially to 10 g/m$^3$, to 20 g/m$^3$, and to 2 g/m$^3$.

As a specific measurement method of the developer amount, in the image forming apparatuses 100 of the present disclosure and the comparative example, printing was performed on 20,000 paper sheets S, and every time when the number of printed sheets reached 1,000, the development device 3*a* was detached for measuring weight of the development casing 20. The weight of developer (stable weight) was calculated by subtracting the weight of the empty development casing 20 without the developer from the measured weight of the development casing 20. In addition, when the number of printed sheets was in the range of 0 to 4,000, the absolute humidity was set to 5 g/m$^3$. When the number of printed sheets was in the range of 4,001 to 8,000, the absolute humidity was set to 10 g/m$^3$. When the number of printed sheets was in the range of 8,001 to 12,000, the absolute humidity was set to 20 g/m$^3$. When the number of printed sheets was in the range of 12,001 to 16,000, the absolute humidity was set to 5 g/m$^3$. When the number of printed sheets was in the range of 16,001 to 20,000, the absolute humidity was set to 2 g/m$^3$.

Figure 7:
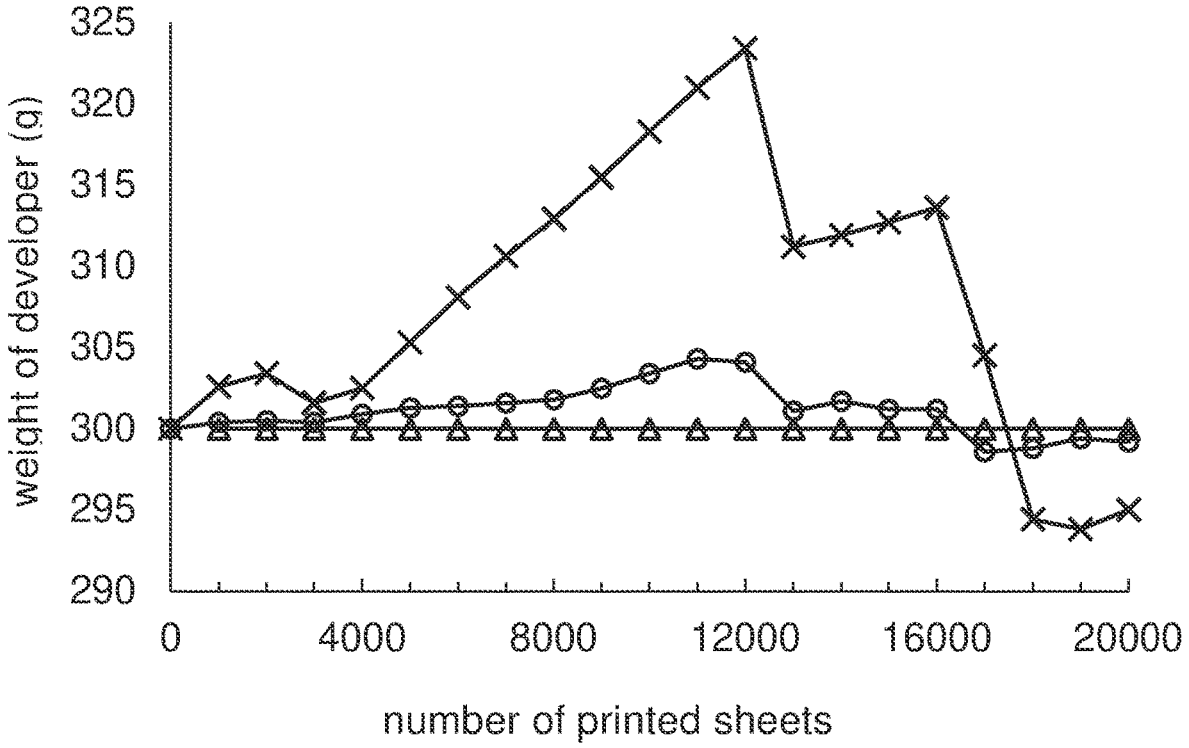
FIG. 7 is a graph showing a result of measuring weight of developer in Example.

The measurement result is shown in the graph of FIG. 7, In the graph of FIG. 7, the present disclosure is shown in ○ data series, and the comparative example is shown in x data series. In addition, as a reference, the line of 300 g of the initial value is shown in Δ data series. In addition, on the basis of this result, the following Table 1 shows average values of weight of the development casing 20 in the image forming apparatuses 100 of the comparative example and the present disclosure, when the absolute humidity is 2 g/m$^3$, 5 g/m$^3$, 10 g/m$^3$, or 20 g/m$^3$.

TABLE 1

| | average weight of developer | |
|---|---|---|
| absolute humidity [g/m$^3$] | comparative example [g] | this invention [g] |
| 2 | 296.9 | 299.0 |
| 5 | 306.6 | 300.8 |
| 10 | 309.2 | 301.5 |
| 20 | 319.6 | 303.6 |

First described is the weight of developer in the development casing (hereinafter, referred to simply as the weight of developer), when the absolute humidity is 5 g/m$^3$, which is the same as that in the initial state (when the number of printed sheets is in the range of 0 to 4,000, and in the range of 12,001 to 16,000). As illustrated in the graph of FIG. 7, when the number of printed sheets is in the range of 0 to 4,000, the weight of developer in the comparative example is increased to 303.4 g at a maximum. In contrast, the weight of developer in the present disclosure is not largely changed, and the maximum value thereof is 300.9 g. In addition, when the number of printed sheets is in the range of 12,001 to 16,000, the maximum value of the weight of developer in the comparative example is 313.6 g. In contrast, the maximum value of the weight of developer in the present disclosure is 301.2 g, and an increase from the initial state is smaller than that in the comparative example.

In addition, as shown in Table 1, when the absolute humidity is 5 g/m$^3$, the average value of the weight of developer in the comparative example is 306.6 g, which is increased from the weight of developer in the initial state (300 g) by 6.6 g. In contrast, the average value of the weight of developer in the present disclosure is 300.8 g, and it is slightly increased from the developer in the initial state by 0.8 g, which is smaller than the increase in the comparative example. In this way, the development devices 3*a* to 3*d* in the present disclosure can suppress increase of the weight of developer to be smaller than that in the development device of the comparative example.

Next described is the weight of developer when the absolute humidity is 10 g/m$^3$ increased from the initial state (when the number of printed sheets is in the range of 4,001 to 8,000). As shown in the graph of FIG. 7, when the number of printed sheets is in the range of 4,001 to 8,000, the weight of developer in the comparative example continues to increase up to 312.9 g at a maximum. In contrast, the weight of developer in the present disclosure is not largely changed, and its maximum value is 301.8 g.

In addition, as shown in Table 1, when the absolute humidity is 10 g/m$^3$, the average value of the weight of developer in the comparative example is 309.2 g, which is increased by 9.2 g from the weight of developer in the initial state (300 g). In contrast, the average value of the weight of developer in the present disclosure is 301.5 g, and it is slightly increased from the developer in the initial state by 1.5 g, which is smaller than the increase in the comparative example. In this way, when the absolute humidity increases, the weight of developer in the comparative example increases, but the development devices 3*a* to 3*d* in the present disclosure can suppress the increase of the weight of developer to be smaller than that in the development device of the comparative example.

Next described is the weight of developer when the absolute humidity is 20 g/m$^3$ increased further from the initial state (when the number of printed sheets is in the range of 8,001 to 12,000). As shown in the graph of FIG. 7, when the number of printed sheets is in the range of 8,001 to 12,000, the weight of developer in the comparative example continues to increase up to 323.4 g at a maximum. In contrast, the weight of developer in the present disclosure has a smaller change than the comparative example, and its maximum value is 304.3 g.

In addition, as shown in Table 1, when the absolute humidity is 20 g/m$^3$, the average value of the weight of developer in the comparative example is 319.6 g, which is increased by 19.6 g from the weight of developer in the initial state (300 g). In contrast, the average value of the weight of developer in the present disclosure is 303.6 g, and it is increased from the developer in the initial state by 3.6 g, which is smaller than the increase in the comparative example. In this way, when the absolute humidity increases, the weight of developer increases, but the image forming apparatus 100 in the present disclosure can suppress the increase of the weight of developer in the development devices 3*a* to 3*d* to be smaller than that in the image forming apparatus 100 of the comparative example.

Next described is the weight of developer when the absolute humidity is 2 g/m decreased from the initial state (when the number of printed sheets is in the range of 16,001 to 20,000). As shown in the graph of FIG. 7, when the number of printed sheets is in the range of 16,001 to 20,000, the weight of developer in the comparative example is rapidly decreased to 292.8 g at a minimum. In contrast, the weight of developer in the present disclosure is slightly decreased to a minimum value of 298.6 g.

In addition, as shown in Table 1, when the absolute humidity is 2 g/m$^3$, the average value of the weight of developer in the comparative example is 296.9 g, which is decreased by 3.1 g from the weight of developer in the initial state (300 g). In contrast, the average value of the weight of developer in the present disclosure is 299 g, which is decreased from the developer in the initial state by 1.0 g, which is smaller than the decrease in the comparative example. In this way, when the absolute humidity decreases, the weight of developer decreases, but the image forming apparatus 100 of the present disclosure can suppress the decrease of the weight of developer in the development devices 3*a* to 3*d* to be smaller than that in the image forming apparatus 100 of the comparative example.

As described above, even if the humidity in the use environment changes, the image forming apparatus 100 of the present disclosure has smaller difference between the replenishment amount and the discharge amount of the developer than that in the image forming apparatus 100 of the comparative example, and it is confirmed that the weight of developer can be stably maintained.

The present disclosure can be applied to image forming apparatuses including the development device that replenishes two component developer containing toner and carrier, and discharges excessive developer. Using the present disclosure, it is possible to provide the image forming apparatus that can decrease variations in volume and weight of the developer in the development casing, even if the flowability of the developer is changed.

What is claimed is:

1. An image forming apparatus, comprising:

a development device, including a development casing having a first transport chamber and a second transport chamber disposed in parallel to each other, a first partition wall for separating the first transport chamber and the second transport chamber along longitudinal direction thereof, a communication part for allowing the first transport chamber and the second transport chamber to communicate with each other at each end side of the first partition wall, a developer replenishment port for replenishing developer containing magnetic carrier and toner, and a developer discharge part disposed at a downstream side end of the second transport chamber so as to discharge excessive developer, a developer carrying member supported by the development casing in a rotatable manner, so as to carry the developer in the second transport chamber on surface thereof, a first stirring transport member having a first rotation shaft disposed in the first transport chamber, and a first transport impeller formed on an outer circumferential surface of the first rotation shaft, so as to stir and transport the developer in the first transport chamber in a first direction, when the first rotation shaft rotates positively, a second stirring transport member having a second rotation shaft disposed in the second transport chamber, and a second transport impeller formed on an outer circumferential surface of the second rotation shaft, so as to stir and transport the developer in the second transport chamber in a second direction opposite to the first direction, when the second rotation shaft rotates positively, a discharge impeller formed on a downstream side of the second transport impeller in the second direction, so as to transport the developer in the same direction as the second transport impeller, and to discharge the developer through the developer discharge part, when the second rotation shaft rotates positively, and a reverse transport impeller formed between the second transport impeller and the discharge impeller, so as to apply a transporting force to the developer in the second transport chamber in the opposite direction to the second transport impeller and the discharge impeller, when the second rotation shaft rotates positively:

a toner storage part for storing the developer to be replenished to the development device:

a drive unit connected to the second rotation shaft so as to rotate the second rotation shaft n positive and reverse directions;

a control unit connected to the drive unit so as to control the second rotation shaft to rotate positively, while controlling the same to rotate reversely by a predetermined rotation amount at a predetermined time interval;

an image carrying member on which an electrostatic latent image is formed: and a toner concentration detection sensor capable of detecting toner concentration in the developer in the development casing, wherein when the second rotation shaft rotates positively or reversely, a developer transporting force of the reverse transport impeller is larger than that of the second transport impeller and the discharge impeller, and the control unit is capable of performing a developer discharge mode, in which the first rotation shaft and the second rotation shaft are rotated reversely during a non image formation period, so that the developer around the reverse transport impeller is discharged through the developer discharge part, and when the toner concentration detected by the toner concentration detection sensor is larger than a predetermined value, the control unit shortens an execution interval between successive executions of the developer discharge mode.

2. The image forming apparatus according to claim 1, further comprising a humidity detection sensor capable of detecting humidity in the image forming apparatus, wherein when the humidity detected by the humidity detection sensor is higher than a predetermined value, the control unit shortens an execution interval between successive executions of the developer discharge mode.

3. The image forming apparatus according to claim 1, wherein a diameter of the reverse transport impeller is larger than or equal to that of the second transport impeller, and a pitch of the reverse transport impeller is smaller than that of the second transport impeller.

4. An image forming apparatus, comprising:

a development device, including a development casing having a first transport chamber and a second transport chamber disposed in parallel to each other, a first partition wall for separating the first transport chamber and the second transport chamber along longitudinal direction thereof, a communication part for allowing the first transport chamber and the second transport chamber to communicate with each other at each end side of the first partition wall, a developer replenishment port for replenishing developer containing magnetic carrier and toner, and a developer discharge part disposed at a downstream side end of the second transport chamber so as to discharge excessive developer, a developer carrying member supported by the development casing in a rotatable manner, so as to carry the developer in the second transport chamber on surface thereof, a first stirring transport member having a first rotation shaft disposed in the first transport chamber, and a first transport impeller formed on an outer circumferential surface of the first rotation shaft, so as to stir and transport the developer in the first transport chamber in a first direction, when the first rotation shaft rotates positively, a second stirring transport member having a second rotation shaft disposed in the second transport chamber, and a second transport impeller formed on an outer circumferential surface of the second rotation shaft, so as to stir and transport the developer in the second transport chamber in a second direction opposite to the first direction. when the second rotation shaft rotates positively, a discharge impeller formed on a downstream side of the second transport impeller in the second direction, so as to transport the developer in the same direction as the second transport impeller, and to discharge the developer through the developer discharge part, when the second rotation shaft rotates positively, and a reverse transport impeller formed between the second transport impeller and the discharge impeller, so as to apply a transporting force to the developer in the second transport chamber in the opposite direction to the second transport impeller and the discharge impeller, when the second rotation shaft rotates positively:

a toner storage part for storing the developer to be replenished to the development device;

a drive unit connected to the second rotation shaft so as to rotate the second rotation shaft in positive and reverse directions;

a control unit connected to the drive unit so as to control the second rotation shaft to rotate positively, while controlling the same to rotate reversely by a predetermined rotation amount at a predetermined time interval:

an image carrying member on which an electrostatic latent image is formed, wherein when the second rotation shaft rotates positively or reversely, a developer transporting force of the reverse transport impeller is larger than that of the second transport impeller and the discharge impeller; and a toner concentration detection sensor capable of detecting toner concentration in the developer in the development casing, and the control unit is capable of performing a developer discharge mode, in which the first rotation shaft and the second rotation shaft are rotated reversely during a non image formation period, so that the developer around the reverse transport impeller is discharged through the developer discharge part wherein the control unit performs the developer discharge mode when the carrier having substantially the same volume as the developer around the reverse transport impeller in the second transport chamber is replenished from the toner storage part.

5. The image forming apparatus according to claim 4, wherein the control unit performs the developer discharge mode also every time a number of sheets printed reaches a predetermined number of sheets.

6. The image forming apparatus according to claim 4, wherein when image formation is performed in a low speed mode in which rotational speed of the second rotation shaft is less than a predetermined value, the control unit shortens an execution interval between successive executions of the developer discharge mode.

* * * * *